United States Patent [19]

Orser, Sr.

[11] 4,319,755

[45] Mar. 16, 1982

[54] TOSSING GAME

[76] Inventor: Garry D. Orser, Sr., P.O. Box 341, Hartland, New Brunswick, Canada, E0J 1N0

[21] Appl. No.: 202,620

[22] Filed: Oct. 31, 1980

[51] Int. Cl.[3] ..... A63B 63/08

[52] U.S. Cl. ..... 273/401; 273/428

[58] Field of Search ..... 273/398–402, 273/428; 434/259

[56] References Cited

U.S. PATENT DOCUMENTS

| | | | |
|---|---|---|---|
| 286,868 | 10/1883 | Thompson | 273/399 |
| 1,174,735 | 3/1916 | Kerr | 273/399 |
| 1,872,454 | 8/1932 | Horn et al. | 273/399 X |
| 2,799,502 | 7/1957 | Isakson | 273/399 |

FOREIGN PATENT DOCUMENTS

| | | | |
|---|---|---|---|
| 351885 | 3/1961 | Switzerland | 273/399 |
| 18891 | of 1909 | United Kingdom | 273/401 |

*Primary Examiner*—Paul E. Shapiro

*Attorney, Agent, or Firm*—D. Paul Weaver

[57] ABSTRACT

A target for tossed game pieces each of pyramid shape and equally sized has a corresponding number of pyramid pockets whose lower points are in a common plane and serve to support the target on a level surface. The target has a flat upper surface flush with the tops of game pieces successfully tossed by players into the pockets. Any apex of a pyramid game piece may enter a pocket downwardly.

7 Claims, 5 Drawing Figures

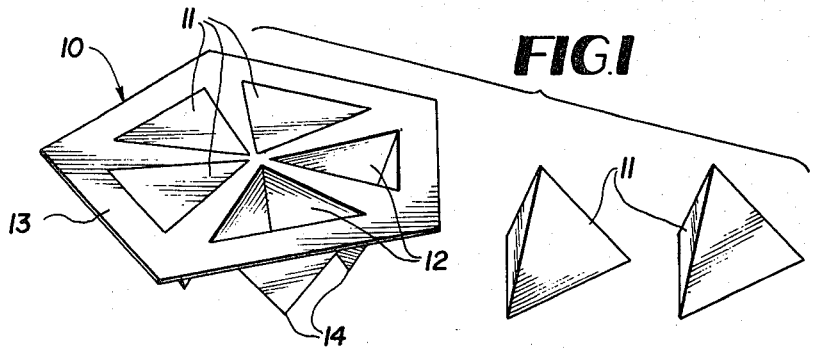
FIG.1
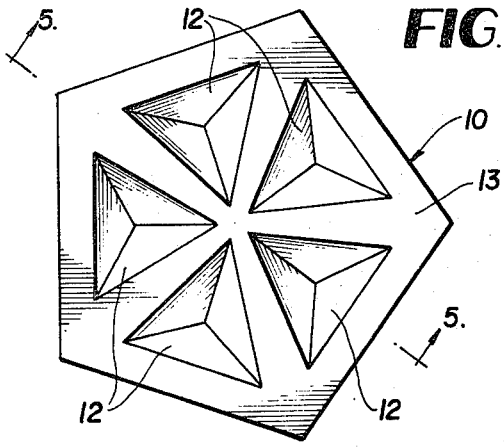
FIG.2
FIG.3
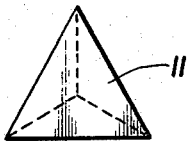
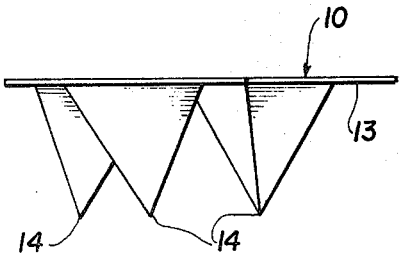
FIG.4
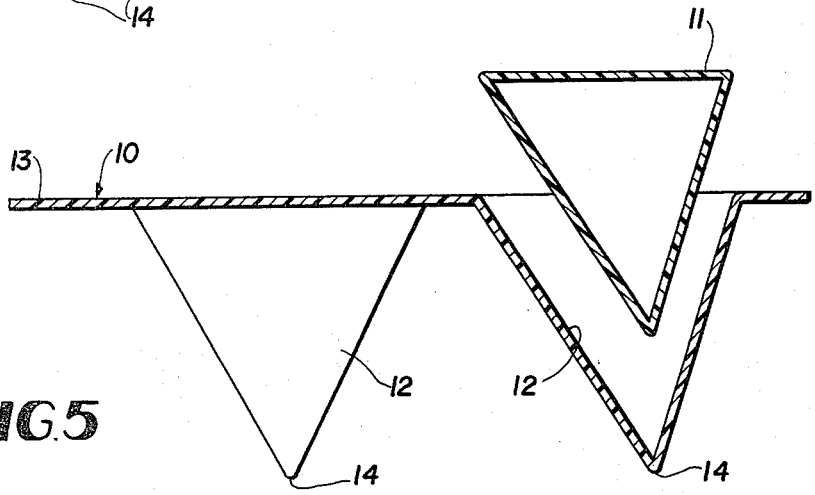
FIG.5

TOSSING GAME

BACKGROUND OF THE INVENTION

Tossing games, broadly speaking, are known in the prior art as where a player standing a certain distance from a target attempts to toss balls into openings or pockets in the target of a size to receive the ball or other missile. Variations of such games are also known in the prior art.

The objective of this invention is to improve on the known prior art relating to tossing games through provision of such game which is more interesting to play and is susceptible to greater variation in the rules of play while utilizing the same game structure.

A further object of the invention is to provide a tossing game apparatus which is extremely simple, economical to manufacture, and attractive and unique in appearance.

A further object is to provide a tossing game in which successfully pocketed game pieces lie flush with the top face of the target so as not to obstruct subsequent oncoming game pieces.

Still another object is to provide a game of the mentioned type where the lower points of the several pyramid pockets serve to support the game board or target on a level surface.

Other objects and advantages of the invention will become apparent during the course of the following description.

BRIEF DESCRIPTION OF THE DRAWINGS

FIG. 1 is a perspective view of a tossing game apparatus according to the present invention.

FIG. 2 is a plan view of a game board or target.

FIG. 3 is a similar view of one pyramid game piece.

FIG. 4 is a side elevation of the target in FIG. 2.

FIG. 5 is an enlarged vertical section through the target taken on line 5—5 of FIG. 2 and showing a game piece entering a target pocket.

DETAILED DESCRIPTION

Referring to the drawings in detail wherein like numerals designate like parts, a tossing game apparatus is depicted comprising a game board 10 or target and plurality of identically shaped and sized pyramid game pieces 11, preferably five in number. The target and the several game pieces can be formed of plastics material or another suitable material.

The target 10 contains five equidistantly spaced pryamid pockets 12 having the same size and shape as each pyramid game piece 11. When a game piece 11 is successfully tossed by a player into one of the pockets 12 of the target, its top face will lie flush in the same plane with a top pentagonal flange or surface 13 of the target 10. This feature prevents successfully pocketed game pieces from interfering with the pocketing of subsequently tossed pieces 11.

The pyramid pockets 12 taper downwardly to lower points 14 which lie in a common plane, thus enabling the several pockets to act as support legs for the target 10 on any level surface. The several game pieces 11 and pyramid pockets 12 are preferably equilaterally formed on all of their triangular faces. The arrangement is such that when the pyramid piece 11 is tossed at the target by a player from a suitable distance, such as a few feet, any point or apex of the piece may enter a pocket 12 and descend therein as depicted in FIG. 5. Once this entry begins, it is virtually assured that the game piece will complete its entry into the pocket, and the pyramid shape assures self-centering and coinciding of the game piece within the pocket 12.

Many variations of game play are possible. In simple form, the target and game pieces are unmarked and the player who requires the fewest number of tosses to fill the pockets 12 is the winner of the game. In a somewhat more complex version, the pockets 12 can be variously colored on their side walls and the pieces 11 can be colored to match the color of the pockets, whereby a player of the game attempts to toss a game piece of one color into a target pocket of like color. In another variation, a face or faces of each game piece may bear a score value number. If such piece is successfully tossed into a pocket 12 with its numbered face upwardly and flush with the surface 13, the player will score that particular number and in so playing the game the player with the greatest numeric total will win the game. Many other interesting variations in play are possible. The game is amusing and interesting and requires skill. It serves as an instructional device for children. It is attractive in appearance and practical and economical to manufacture.

It is to be understood that the form of the invention herewith shown and described is to be taken as a preferred example of the same, and that various changes in the shape, size and arrangement of parts may be restored to, without departing from the spirit of the invention or scope of the subjoined claims.

I claim:

1. A tossing game comprising a target adapted to rest on a level surface and having plural top opening pyramid pockets, and a corresponding number of like shaped and sized pyramid game pieces adapted to be tossed from a distance by a player of the game into the pockets.

2. A tossing game as defined in claim 1, and said target having a flat top surface flush with the open tops of the pyramid pockets, and the tops of game pieces successfully tossed into said pockets lying flush with said top surface in a common plane therewith.

3. A tossing game as defined in claim 2, and the bottoms of the pyramid pockets being defined by points lying in a common level plane, whereby the target may rest through said points on a level support surface.

4. A tossing game as defined in claim 1, and said pyramid pockets being circumferentially equidistantly spaced in said target.

5. A tossing game as defined in claim 4, and the side walls of the pockets and game pieces being equilaterally formed.

6. A tossing game as defined in claim 4, and said flat top surface of the target being pentagonal, said pockets and said game pieces each being five in number.

7. A tossing game as defined in claim 1, and said target formed from thin walled stiff material, said pyramid game pieces being hollow.

* * * * *